US007035424B1

(12) United States Patent
Brandt

(10) Patent No.: US 7,035,424 B1
(45) Date of Patent: Apr. 25, 2006

(54) LOUDSPEAKER HAVING AN INNER LEAD WIRE SYSTEM AND RELATED METHOD OF PROTECTING THE LEAD WIRES

(76) Inventor: Eugene P. Brandt, 10825 Blandville Rd., West Paducah, KY (US) 42086

( * ) Notice: Subject to any disclaimer, the term of this patent is extended or adjusted under 35 U.S.C. 154(b) by 329 days.

(21) Appl. No.: 10/119,260

(22) Filed: Apr. 9, 2002

Related U.S. Application Data

(60) Provisional application No. 60/291,976, filed on May 18, 2001.

(51) Int. Cl.
*H04R 25/00* (2006.01)

(52) U.S. Cl. ..... 381/409; 381/410; 381/412; 381/420

(58) Field of Classification Search ..... 381/396, 381/400, 407, 409, 410, 412, 420, 403, 423, 381/424, 429, 404, 405, 432
See application file for complete search history.

(56) References Cited

U.S. PATENT DOCUMENTS

| | | | | |
|---|---|---|---|---|
| 1,899,561 | A | 2/1933 | Dorsey | |
| 1,962,012 | A | 6/1934 | Grassmann | |
| 2,110,200 | A | 3/1938 | Clarke | |
| 2,906,828 | A | 9/1959 | Carbonneau | |
| 3,711,659 | A * | 1/1973 | Bremseth | 381/410 |
| 4,061,890 | A | 12/1977 | Froeschle | |
| 4,234,766 | A | 11/1980 | Cacho | |
| 4,315,112 | A | 2/1982 | Hofer | |
| 4,807,295 | A | 2/1989 | Dombroski | |
| 5,008,945 | A | 4/1991 | Murayama et al. | |
| 5,249,236 | A | 9/1993 | Sakamoto | |
| 5,734,734 | A | 3/1998 | Proni | |
| 5,748,760 | A | 5/1998 | Button | |

* cited by examiner

*Primary Examiner*—Huyen Le
(74) *Attorney, Agent, or Firm*—King & Schickli, PLLC

(57) ABSTRACT

A loudspeaker for generating sound from an electrical current provided by an external source may include an adapter and/or a guide for supporting, directing and routing lead wires carrying the electrical current from the external source. The lead wires may be routed through a guide supported by a pole assembly in the center of the loudspeaker in order to keep the mass associated with the lead wires as near as possible to a moving voice coil former. In this manner, detrimental effects of premature failures and undesirable noise caused by movement of loudspeaker components during operation may be significantly reduced. The guide may include apertures for supporting the lead wires at a desired angle and directing the lead wires toward the external source. Alternatively, or in combination with the aforementioned guide, the lead wires may be routed through an adapter attached to the voice coil former. The adapter may include apertures for positioning splices connecting flexible wires and voice coil lead wires which form the lead wires. A method of protecting the lead wires which carry the electric signal from the external source to the loudspeaker from damage due to movement during operation of the loudspeaker is also provided.

22 Claims, 4 Drawing Sheets

LOUDSPEAKER HAVING AN INNER LEAD WIRE SYSTEM AND RELATED METHOD OF PROTECTING THE LEAD WIRES

This application claims the benefit of Provisional Application No. 60/291,976, filed May 18, 2001.

FIELD OF THE INVENTION

The present invention relates to the field of loudspeakers, and more particularly to loudspeakers having an inner lead wire system wherein the lead wires are supported, directed and routed in a manner which reduces premature failure and noise caused by movement of the lead wires.

BACKGROUND OF THE INVENTION

Conventional loudspeakers produce audible sounds by displacing air via the movement of a diaphragm. Specifically, the diaphragm is attached to a voice coil former and moves under the control of a voice coil through which electric current associated with the sounds to be reproduced is driven. The voice coil is disposed in an annular air gap defined by a pole assembly. The pole assembly includes a permanent magnet that provides radial flux in the air gap. Lead wires provide the electric current to the voice coil which interacts with this flux to provide axial forces on the voice coil and voice coil former which displace the voice coil, former, and the attached diaphragm. The displacement or movement of the voice coil and former is controlled by the magnitude and direction of current in the coil and the resulting axial forces.

Typically, loudspeaker lead wires are routed from the voice coils along the voice coil former, and either through or beneath the diaphragm to an input terminal board connector attached to a basket. The lead wires are generally single strand wires connected to the voice coil which are then attached to flexible wires. The flexible wires are typically heavier than the single strand voice coil wire and are designed to provide additional flexibility intended to accommodate movement of the loudspeaker components during operation. The voice coil wires are affixed to the voice coil former and routed along the former to a location above a spider and apex of the diaphragm where the wires are spliced to the flexible wires. The flexible wires are typically routed along the diaphragm, through an aperture or hole therein, and terminated at the input terminal board connector. In other embodiments, the flexible wires are routed in a space between the spider and diaphragm eliminating the need to pass through the diaphragm, or along or embedded in the spider.

In each of these loudspeaker systems, however, the repetitive movement of the lead wires in association with the voice coil former and diaphragm can cause failures in the lead wires and reduce the quality of the loudspeaker performance. For example, bending and changing the geometry of the lead wires can contribute to premature failure due to fatigue or short circuiting between lead wires and/or other loudspeaker components. Additionally, undesirable noise created through contact between the lead wires and other loudspeaker components, such as the diaphragm, can negatively impact loudspeaker performance.

It has come to our attention that these shortcomings in present loudspeaker design are exacerbated by the effect of the lead wires own mass. The farther the mass is away from a center axis of the voice coil, the more the mass resists the changes of direction that the voice coil and diaphragm are attempting to make. Thus, an important aspect of the present invention is to substantially reduce, if not eliminate, the effect of the lead wires mass in contributing to premature failure and reducing the quality of loudspeaker performance by properly supporting, directing and routing the lead wires.

SUMMARY OF THE INVENTION

In accordance with the present invention, there is provided a loudspeaker for generating sound from an electrical current provided by an external source. The loudspeaker includes a voice coil through which the current flows, a voice coil former for supporting the voice coil, a diaphragm attached to the voice coil former, a pole assembly defining an annular gap having an inner and outer diameter in which the voice coil is located, a permanent magnet for producing a magnetic field in the annular gap for interacting with the current to produce an axial movement of the voice coil and former of at least one quarter inch from a peak forward position to a peak reverse position, and at least two flexible wires routed through the diaphragm and extending at least partially through the pole assembly for electrically connecting the external source to the voice coil. In one embodiment, the pole assembly includes a backplate for supporting a pole yoke, the pole yoke defining the inner diameter of the annular gap and extending through the permanent magnet, and a top plate defining the outer diameter of the annular gap.

The loudspeaker may further include a guide at least partially supported by the pole yoke through which the flexible wire extends for directing the flexible wires toward the external source. Preferably, the guide includes a cylindrically shaped support partially extending above the voice coil former, and a cap. The cap may have apertures within which the flexible wires are supported at angles to a lengthwise axis of rotation of the guide. The flexible wires may be braided and may be routed through the diaphragm at least twice or attached to the diaphragm.

In another embodiment, the loudspeaker includes a voice coil through which the current flows supported by a former, a diaphragm, an adapter attached to the voice coil former and partially supporting the diaphragm, a pole assembly defining an annular gap having an inner and outer diameter in which the voice coil is located, a permanent magnet for producing a magnetic field in the annular gap to produce an axial movement of the voice coil former, and at least two flexible wires at least partially supported by the adapter for delivering the current from the external source to the voice coil through the adapter. Preferably, the adapter includes at least two apertures for positioning splices between the at least two flexible wires and the voice coil, and the flexible wires are routed through the adapter and extend at least partially through the pole assembly.

In this embodiment, the pole assembly may include a backplate for supporting a pole yoke which defines the inner diameter of the annular gap and extending through the permanent magnet, and a top plate defining the outer diameter of the annular gap. The embodiment further includes a guide which is at least partially supported by the pole yoke for directing the flexible wires toward the external source. Preferably, the guide includes at least two apertures within which the flexible wires are supported at an angle to a lengthwise axis of rotation of the guide. The guide may include a substantially cylindrical support and a cap wherein the at least two apertures are positioned. Further, the adapter preferably includes at least two apertures having at least two different diameters for positioning splices between the at least two flexible wires and the voice coil. The flexible wires preferably extend at least partially through the pole assembly for delivering the current from the external source to the voice coil.

In yet another embodiment, the loudspeaker for generating sound from an electrical current provided by an external source may include a basket, a voice coil through which the current flows, a former supporting the voice coil, a diaphragm attached to the basket for generating sound, an adapter attached to the voice coil former and partially supporting the diaphragm, a spider attached to the basket and the voice coil former for maintaining a position of the voice coil former, a pole assembly attached to the basket and defining an annular gap having an inner and an outer diameter in which the voice coil is located, a permanent magnet for producing a magnetic field in the annular gap to produce an axial movement of the voice coil former of at least one quarter inch from a peak forward position to a reverse position, at least two flexible wires partially supported by the adapter for delivering the current from the external source to the voice coil, and a guide supported by the pole assembly for directing the flexible wires toward the external source. The guide may include a cylindrically shaped support partially extending above the voice coil former, and a cap. The cap may include at least two apertures within which the flexible wires are supported at an angle to a lengthwise axis of rotation of the support. The adapter may include at least two apertures having at least two different diameters for positioning splices between the at least two flexible wires and the voice coil.

In accordance with the method of the present invention, voice coil lead wires which carry an electrical signal from an external source to a loudspeaker are protected from damage due to axial movement during operation of the loudspeaker of at least substantially one quarter inch from a peak forward position to a peak reverse position by supporting at least one voice coil having lead wires on a former, splicing the voice coil lead wires to flexible wires, and routing the flexible wires from the external source supplying the electrical signal through a guide at least partially supported by a pole assembly, and twice through a diaphragm. In addition, the flexible wires may be positioned such that the flexible wires enter an aperture in the guide at an angle to a lengthwise axis of rotation of the guide.

In an alternate method in accordance with the present invention, voice coil lead wires which carry an electrical signal from an external source to a loudspeaker are protected from damage due to axial movement during operation of the loudspeaker of at least substantially one quarter inch from a peak forward position to a peak reverse position by supporting at least one voice coil having lead wires on a former, splicing the voice coil lead wires to flexible wires, and routing the flexible wires from the external source supplying the electrical signal through an adapter supported by the former. In addition, the splices may be positioned within apertures in the adapter to prevent their movement, and the flexible wires may be partially supported by second apertures in the adapter to prevent rotation of the flexible wires within the apertures. Last, the flexible wires may be directed through the center of the former toward the external source.

Still other objects of the present invention will become apparent to those skilled in this art from the following description wherein there is shown and described the preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
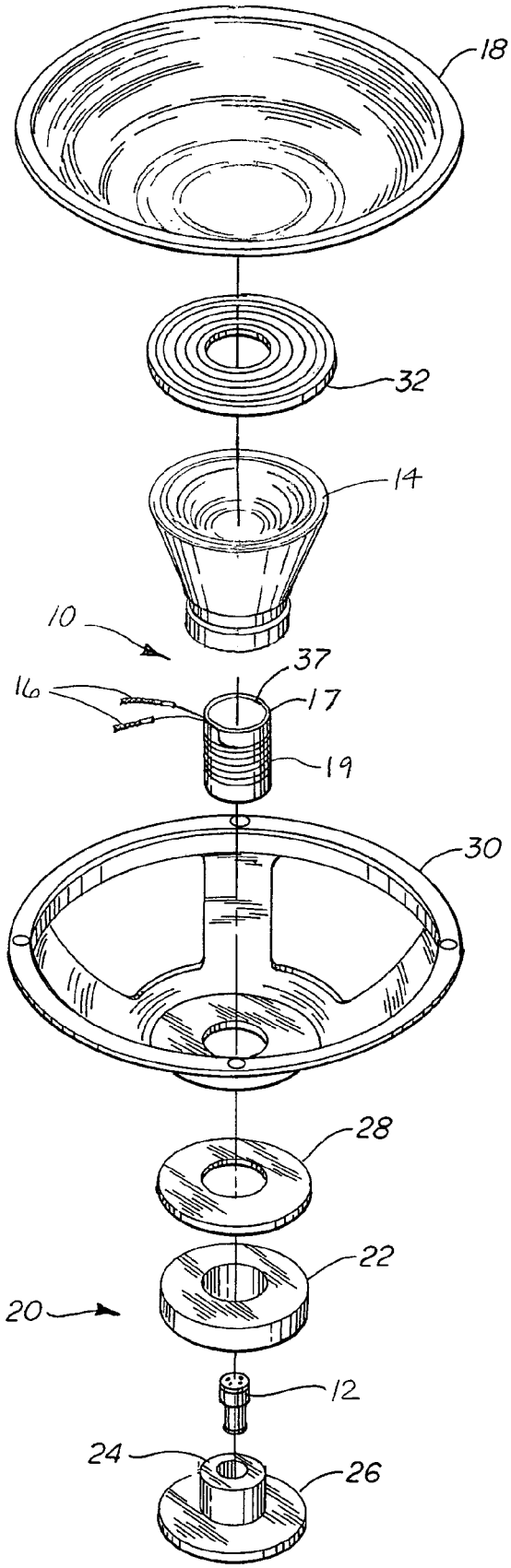
FIG. 1 is an exploded isometric view of a loudspeaker in accordance with the present preferred invention.

With reference to the exploded view of FIG. 1, there is shown a preferred embodiment of a loudspeaker 10 for generating sound from an electrical current. The loudspeaker 10 is of a type generally known in the art but includes a guide 12 and an adapter 14 for supporting, directing and routing voice coil lead wires 16 in a manner which reduces premature failure and noise caused by movement of the lead wires.

The loudspeaker 10 includes a deflectable diaphragm 18 which is supported by the adapter 14 in the present preferred embodiment. The adapter 14 which is described in greater detail below is attached to and controlled by the movements of a voice coil former 17. A Voice coil 19 supported by the former 17 is located within an annular gap defined by a pole assembly 20. Specifically, the pole assembly 20 includes a permanent magnet 22, a pole yoke 24 supported by a backplate 26, and a top plate 28. Pole yoke 24, backplate 26 and top plate 28 are each constructed from a ferrous material. The pole yoke 24 extends through the permanent magnet 22 and the top plate 28 and defines the inner diameter of the annular gap within which the former 17 and voice coil 19 move. The top plate 28 and permanent magnet 22 define the outer diameter of the gap.

In accordance with standard loudspeaker operation, the permanent magnet 22 produces a magnetic field within the air gap interacting with the current in the voice coil 19 to produce movement of the voice coil, voice coil former 17, the adapter 14, and in turn the diaphragm 18 to produce sound. A basket 30 is attached to and supports the pole assembly 20, the diaphragm 18, and a spider 32 for maintaining a central position of the voice coil 19 and former 17.

Figure 2:
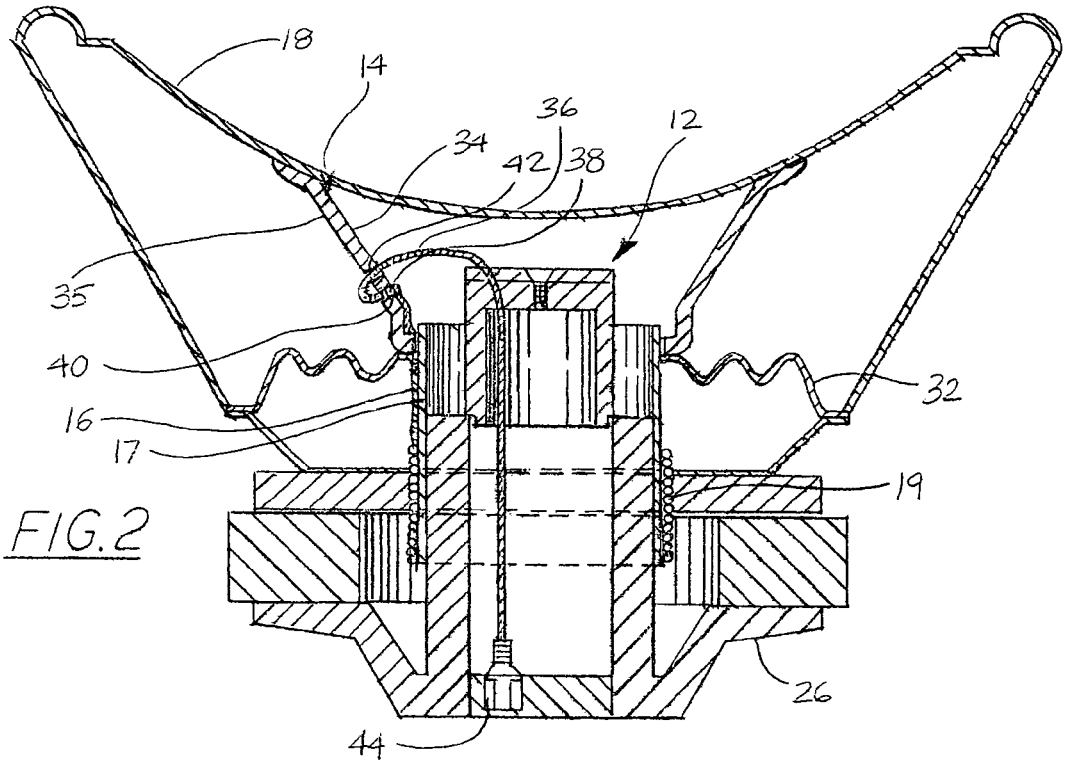
FIG. 2 is a cross-sectional view of the loudspeaker illustrating the present preferred routing of the voice coil lead wires through an adapter supporting a diaphragm and a guide supported by a pole assembly.

In the preferred embodiment of the present invention shown in FIG. 2, the voice coil lead wires 16 include two single strand wires extending from the voice coil 19. The single strand wires 16 may be glued or otherwise attached to the former 17 as is known in the art. At a point above the spider 32, the single strand wires 16 are routed along an inner surface 34 of the adapter 14 and spliced to two flexible or braided wires 36. The flexible or braided wires 36 can be any type of wire(s) which is more flexible than a single strand wire. In accordance with an important aspect of the present invention, the splices 38 or connection points between the single wires 16 and the braided wires 36 are positioned by apertures 40 in a sidewall 35 of the adapter 14 as will be described in greater detail below. The braided wires 35 are subsequently routed back through additional apertures 42 in the adapter 14 to prevent rotation of the braided wires 36 caused by movement of the voice coil 19, former 17, adapter 14, and diaphragm 18 during operation. Rotation may be prevented by forming the apertures 42 such that the braided wires 36 are firmly held in position. In other words, a diameter of the apertures may be selected to provide a snug fit or, more simply, the braided wires 36 may be glued in place. The braided wires 36 are then routed through the guide 12 as described in greater detail below to a connector 44 positioned adjacent the back plate 26 for attachment to an external source (not shown).

Figure 3:
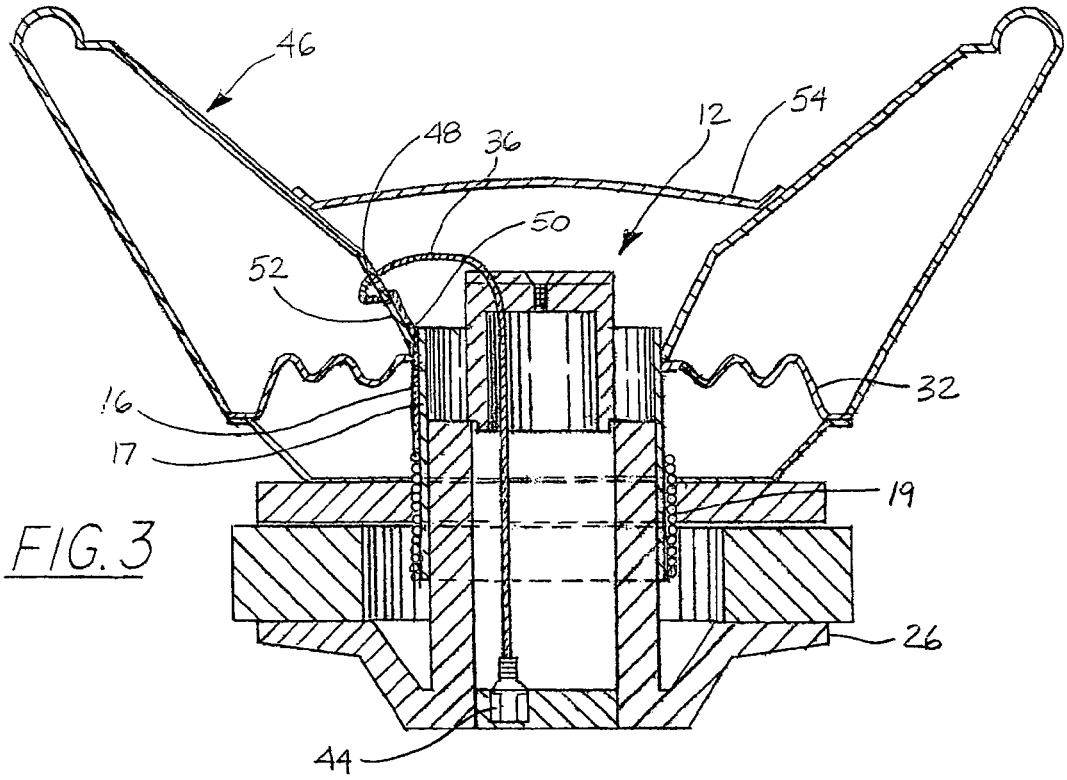
FIG. 3 is a cross-sectional view of the loudspeaker illustrating alternate routing of the voice coil lead wires through the diaphragm and the guide supported by the pole assembly.

In an alternate embodiment of the present invention shown in FIG. 3, a diaphragm 46 is attached to the voice coil former 17, as opposed to being supported by an adapter, and the braided wires 36 are routed through apertures 48 in the diaphragm. As in the previous embodiment, the voice coil lead wires 16 or single wires extending from the voice coil 19 are affixed to the voice coil former 17. At a point above the spider 32, the single wires 16 are spliced to the braided wires 36. Preferably, the splices 50 are positioned near the former 17 as shown. However, the location of the splices 50 may vary. The braided wires 36 may be routed along and may be affixed to an outward facing surface 52 of the diaphragm 46 to minimize movement of the wires during operation of the loudspeaker.

In accordance with an important aspect of the invention, the braided wires 36 are looped through the apertures 48 of the diaphragm 46 in order to properly position the braided wires for optimum performance and preferably, prevent their movement. The braided wires 36 are further routed through the guide 12 to a connector 44 positioned on the back plate 26 for attachment to the external source as in the previous embodiment. As is well known in the art, a cap 54 may be utilized to cover the opening in the diaphragm 46 if desired.

Figure 4:
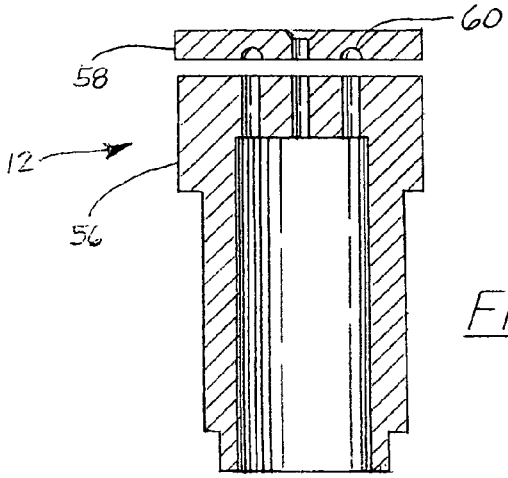
FIG. 4 is a side elevational view of the preferred guide of the loudspeaker.

As best shown in FIG. 4, the preferred guide 12 includes a cylindrically shaped support 56 which may be supported by the pole yoke 24, and a cap 58. The guide 12 may extend above the voice coil former 17 and through the pole assembly 20. In accordance with the broad teachings of the present invention, the guide 12 can be made of any shape or length limited only by the parameters of the loudspeaker. The cap 58 includes two apertures 60 within which the braided wires 36 are positioned and supported. Preferably, the apertures 60 are spaced 90° or 180° apart and support the braided wires 36 at an angle which reduces the effects of movement of the voice coil former 17 and the diaphragm 18, 46 on the braided wires. In accordance with the broad teachings of the present invention, the angles at which the flexible wires are supported may range from 0° to 90°. Alternate embodiments wherein two or more voice coils are positioned on a voice coil former may require additional apertures in the cap to support and position the additional braided wires. Preferably, the apertures are spaced an equidistance apart independent of the number of voice coils.

Figure 5:
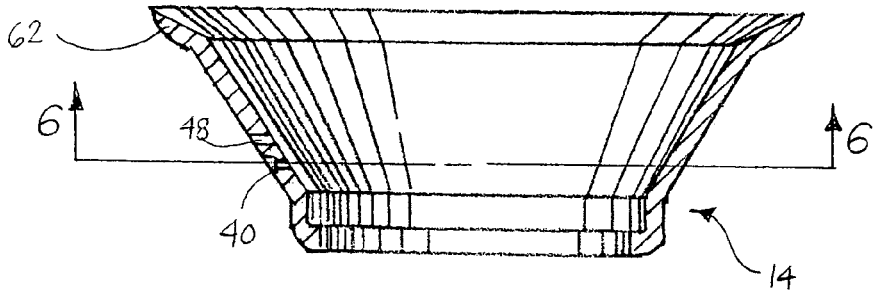
FIG. 5 is a side elevational view of the preferred adapter of the loudspeaker.
Figure 6:
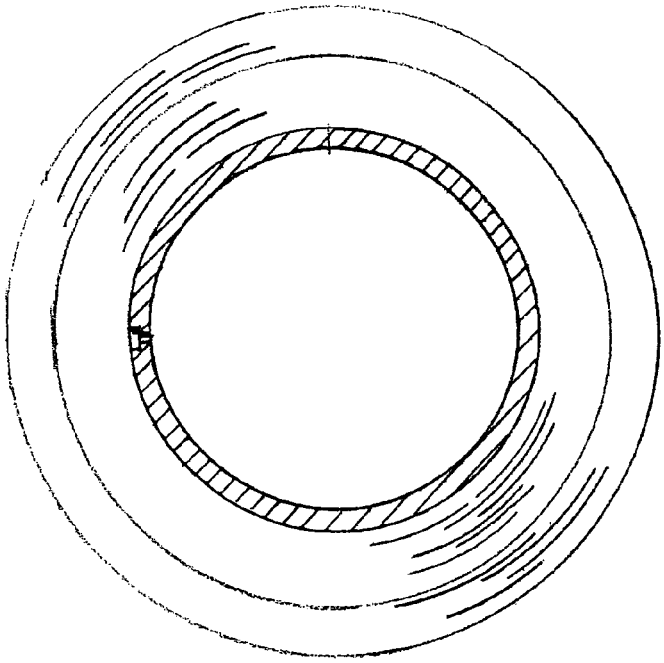
FIG. 6 is a cross-sectional view of the preferred adapter showing an aperture for positioning a splice between the single strand and flexible wires.
Figure 7:
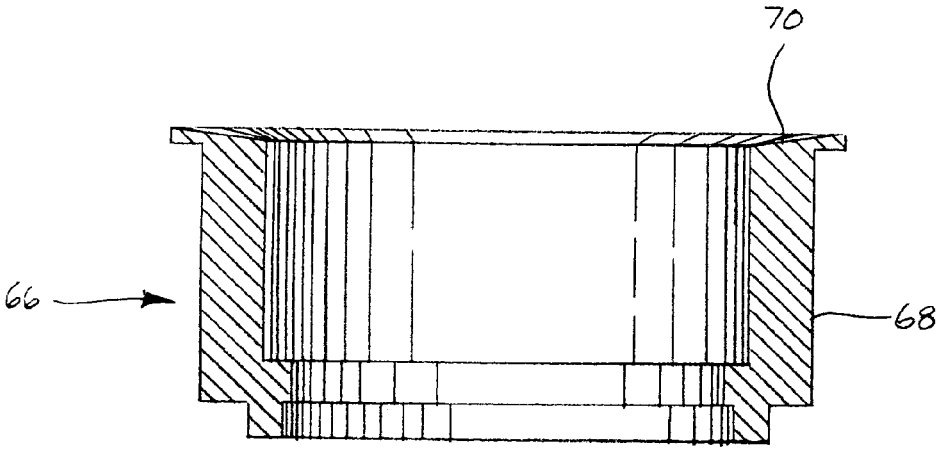
FIG. 7 is a side elevational view of an alternate adapter of the loudspeaker having vertical sidewalls.

As best shown in FIG. 5, the preferred adapter 14 is generally cylindrically shaped having a flared sidewall 35 and a borehole through its center. An upper portion 62 of the sidewall 35 is further flared outwardly to increase the amount of sidewall surface area contacting and supporting the diaphragm 18 as best seen in FIG. 2. In accordance with the broad teachings of the present invention, the adapter 14 can be made of any shape, length, or width limited only by the parameters of the speaker 10. For example, an alternate adapter 66, shown in FIG. 7, may have vertical sidewalls 68 with a chamfer 70 formed along their upper surface for contacting and supporting a diaphragm.

As indicated above, the present preferred adapter 14 includes apertures 40 having at least two different diameters. The different diameters position the splices 38 connecting the single wires 16 and the braided wires 36 in or near the sidewall 35 of the adapter 14. More specifically, the apertures 40 include boreholes of a first diameter and counterbores of a second larger diameter. Alternately, a single diameter borehole or a plurality of different diameter counterbores may be utilized, or more simply, a hole having a tapered diameter so long as the function of positioning the splices is performed.

In accordance with the method of the present invention, voice coil lead wires 16 of a loudspeaker 10 shown in FIG. 2 for example, are protected from damage due to movement of the voice coil former 17 of at least substantially one quarter inch from a peak forward position to a peak reverse position during operation of the loudspeaker. As described in greater detail above, a voice coil 19 is supported on a voice coil former 17. Single strand wires 16 forming the ends of the voice coil 19 are spliced to flexible wires 36. In accordance with an important aspect of the method of the present invention, the flexible wires 36 are routed from an external source supplying an electrical signal through an adapter 14 supported by the former 17. The present preferred method of protecting the lead wires of the loudspeaker 10 from damage may include positioning the splices 38 within apertures 40 in the adapter 14 in order to prevent movement of the splices. The flexible wires 36 may be further at least partially supported within second apertures 42 in the adapter 14 to prevent rotation of the flexible wires.

In accordance with an alternate method, voice coil lead wires 16 of the loudspeaker 10 shown in FIG. 3 for example, are protected from damage due to movement of the voice coil former 17 of at least substantially one quarter inch from a peak forward position to a peak reverse position during operation of the loudspeaker. As described in greater detail above, a voice coil 19 is supported on a voice coil former 17. Single strand wires 16 forming the ends of the voice coil 19 are spliced to flexible wires 36. In accordance with an important aspect of the alternate method, the flexible wires 36 are routed from an external source supplying an electrical signal through a guide 12 at least partially supported by a pole assembly 24, and a diaphragm 46 to a splice point. The alternate method may further include positioning the flexible wires 36 such that the wires enter an aperture in the guide 12 at an angle in order to limit the effects of the movement.

Figure 8:
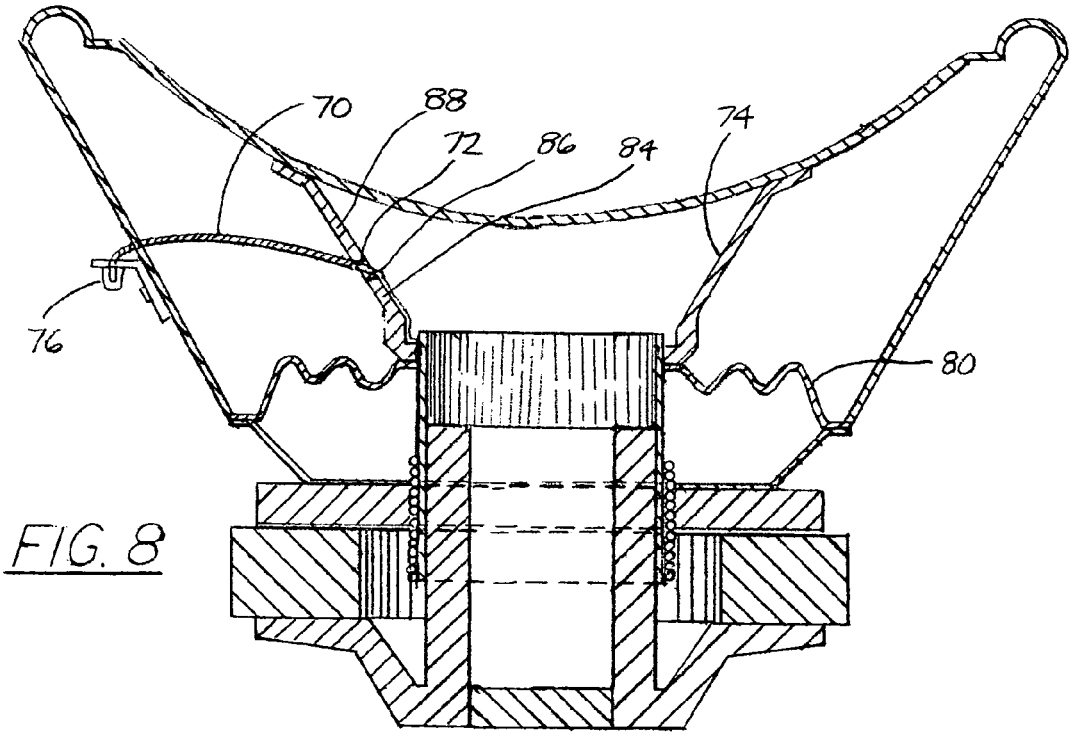
FIG. 8 is a cross-sectional view of the loudspeaker illustrating another alternate routing of the voice coil lead wires through an adapter supported by the diaphragm.

The foregoing description of a preferred embodiment of the invention has been presented for purposes of illustration and description. It is not intended to be exhaustive or to limit the invention to the precise form disclosed. Obvious modifications for variations are possible in light of the above teachings. In another alternate embodiment shown in FIG. 8, for example, the braided wires 70 may be routed through an aperture 72 in an adapter 74 to a terminal board connector 76 mounted on a basket 78, and not through a guide and pole assembly. At a point above a spider 80, voice coil lead wires 82 are routed along an inner surface of the adapter 84 and spliced to the flexible or braided wires 70. In accordance with an important aspect of the present invention, the splices 86 between the single wires 82 and the braided wires 70 are positioned by the apertures 72 in a sidewall 88 of the adapter 74. As described above, the apertures 72 preferably include at least two different diameters in order to receive and position the splices 86 in the adapter.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A loudspeaker for generating sound from an electrical current provided by an external source comprising:

a voice coil through which the current flows;

a former supporting said voice coil;

a diaphragm attached to said voice coil former;

a pole assembly defining an annular gap in which the voice coil is located, the annular gap having an inner and outer diameter;

a permanent magnet for producing a magnetic field in the annular gap, the magnetic field interacting with the current to produce an axial movement of said voice coil former; and at least two flexible wires routed through said diaphragm and extending at least partially through said pole assembly for electrically connecting the external source to said voice coil.

2. The loudspeaker of claim 1, wherein said pole assembly includes a backplate for supporting a pole yoke, said pole yoke defining the inner diameter of the annular gap and extending through said permanent magnet, and a top plate, said top plate defining the outer diameter of the annular gap.

3. The loudspeaker of claim 2, further comprising a guide at least partially supported by said pole yoke through which said flexible wires extend.

4. The loudspeaker of claim 3, wherein said guide comprises a cylindrically shaped support partially extending above said voice coil former, and a cap.

5. The loudspeaker of claim 4, wherein said cap includes at least two apertures within which said flexible wires are supported at an angle to a lengthwise axis of rotation of said guide.

6. The loudspeaker of claim 1, wherein at least one of said flexible wires is routed through said diaphragm at least two times.

7. The loudspeaker of claim 6, further comprising a guide supported by said pole assembly for directing said flexible wires toward the external source.

8. The loudspeaker of claim 1, wherein said flexible wires are braided wires attached to said diaphragm.

9. A loudspeaker for generating sound from an electrical current provided by an external source comprising:

a voice coil through which the current flows supported by a former;

a diaphragm;

an adapter attached to said voice coil former and partially supporting said diaphragm;

a pole assembly defining an annular gap in which the voice coil is located, the annular gap having an inner and outer diameter;

a permanent magnet for producing a magnetic field in the annular gap, the magnetic field interacting with the current to produce an axial movement of said voice coil former; and at least two flexible wires partially supported by and routed through said adapter and at least partially extending through said pole assembly for delivering the current from the external source to said voice coil.

10. The loudspeaker of claim 9, wherein said adapter includes at least two apertures supporting splices between said at least two flexible wires and said voice coil.

11. A loudspeaker for generating sound from an electrical current provided by an external source comprising:

a voice coil through which the current flows supported by a former;

a diaphragm;

an adapter attached to said voice coil former and partially supporting said diaphragm;

a pole assembly defining an annular gap in which the voice coil is located, the annular gap having an inner and outer diameter, said pole assembly includes a backplate for supporting a pole yoke, said pole yoke defining the inner diameter of the annular gap and extending through said permanent magnet, and a top plate, said top plate defining the outer diameter of the annular gap;

a permanent magnet for producing a magnetic field in the annular gap, the magnetic field interacting with the current to produce an axial movement of said voice coil former;

at least two flexible wires partially supported by said adapter for delivering the current from the external source to said voice coil; and a guide at least partially supported by said pole yoke for directing said flexible wires toward the external source.

12. The loudspeaker of claim 11, wherein said guide includes at least two apertures within which said flexible wires are supported at angles to a lengthwise axis of rotation of said guide.

13. The loudspeaker of claim 12, wherein said guide comprises a substantially cylindrical support and a cap.

14. The loudspeaker of claim 13, wherein said at least two apertures of said guide are in said cap.

15. The loudspeaker of claim 11, wherein said adapter includes at least two apertures having at least two different diameters for positioning splices between said at least two flexible wires and said voice coil.

16. The loudspeaker of claim 15, wherein said at least two flexible wires are routed at least partially through said pole assembly.

17. A loudspeaker for generating sound from an electrical current provided by an external source comprising:

a basket;

a voice coil through which the current flows;

a former supporting said voice coil;

a diaphragm attached to said basket for generating sound;

an adapter attached to said voice coil former and partially supporting said diaphragm;

a spider attached to said basket and said voice coil former for maintaining a position of said voice coil former;

a pole assembly attached to said basket and defining an annular gap in which the voice coil is located, the annular gap having an inner and an outer diameter;

a permanent magnet for producing a magnetic field in the annular gap, the magnetic field interacting with the current to produce an axial movement of said voice coil former of at least one quarter inch from a peak forward position to a reverse position;

at least two flexible wires partially supported by said adapter for delivering the current from the external source to said voice coil; and a guide supported by said pole assembly for directing said flexible wires toward the external source.

18. The loudspeaker of claim 17, wherein said guide comprises a cylindrically shaped support partially extending above said voice coil former, and a cap.

19. The loudspeaker of claim 18, wherein said cap includes at least two apertures within which said flexible wires are supported at an angle to a lengthwise axis of rotation of said support.

20. The loudspeaker of claim 17, wherein said adapter includes at least two apertures each having at least two different diameters for positioning splices between said at least two flexible wires and said voice coil.

21. A loudspeaker for generating sound from an electrical current provided by an external source comprising:

a voice coil through which the current flows;

a former supporting said voice coil;

a diaphragm supported by said voice coil former;

a pole assembly defining an annular gap in which the voice coil is located, the annular gap having an inner and outer diameter;

a permanent magnet for producing a magnetic field in the annular gap, the magnetic field interacting with the current to produce an axial movement of said voice coil former; and at least two flexible wires routed through said diaphragm and extending at least partially through said pole assembly for electrically connecting the external source to said voice coil.

22. The loudspeaker of claim 21 further comprising a guide at least partially supported by said pole assembly through which said flexible wires extend.

* * * * *